United States Patent [19]

Kranc

[11] 4,081,140

[45] Mar. 28, 1978

[54] CAPSULE-TYPE FUEL NOZZLE

[75] Inventor: Stanley J. Kranc, Morton, Ill.

[73] Assignee: Caterpillar Tractor Co., Peoria, Ill.

[21] Appl. No.: 706,713

[22] Filed: Jul. 19, 1976

[51] Int. Cl.[2] ..... F02M 61/20

[52] U.S. Cl. ..... 239/533.9; 239/574

[58] Field of Search ..... 239/99, 453, 456, 459, 239/533.2, 533.3, 533.7, 533.9, 533.11, 584, 574, 533.4, 533.5

[56] References Cited

U.S. PATENT DOCUMENTS

| | | | |
|---|---|---|---|
| 2,771,321 | 11/1956 | Alric | 239/533.7 |
| 3,257,078 | 6/1966 | Mekkes | 239/584 X |

FOREIGN PATENT DOCUMENTS

| | | | |
|---|---|---|---|
| 296,354 | 5/1932 | Italy | 239/533.9 |

*Primary Examiner*—Bruce H. Stoner, Jr.
*Assistant Examiner*—Andres Kashnikow
*Attorney, Agent, or Firm*—Phillips, Moore, Weissenberger, Lempio & Majestic

[57] ABSTRACT

A fuel injection nozzle assembly includes a retraction valve disposed and encapsulated within the same housing as the injector valve for thereby reducing the amount of fuel trapped between these valves so that the retraction valve can retract a calculated volume of the trapped fuel abruptly and obtain a sharp ending of the injection cycle.

3 Claims, 2 Drawing Figures

CAPSULE-TYPE FUEL NOZZLE

BACKGROUND OF THE INVENTION

The present invention relates to fuel injection systems and pertains more particularly to a conventional fuel injection nozzle assembly with a retraction type valve added within the assembly.

Compression ignition engines commonly employ fuel injection nozzles for delivering a timed injection and metered quantity of fuel into the engine combustion chamber. Such nozzles are normally controlled by a pressure-responsive check valve to prevent dribbling of fuel into the combustion chamber between injection strokes. Most injection systems also employ a retraction type delivery valve at the fuel pump outlet for establishing a sharp decrease in fuel pressure in the fuel line to the fuel injection nozzle at the end of an injection cycle.

The injection pump and thus the retraction valve are normally located some distance from the injection nozzle itself, resulting in the entrapment of a relatively large volume of fuel in the fuel line between the injection and retraction valves. For this reason and because fuel is compressible, it has been found that an abrupt termination of the injection of fuel into the engine, at the end of the injection cycle does not occur. This is true despite the numerous improvements made in injector nozzles.

The following patents are examples of the prior art construction of injection nozzles. U.S. Pat. No. 3,382,851 issued May 14, 1968, to De Luca; U.S. Pat. No. 3,511,443 issued May 12, 1976, to Glikin, et al.; U.S. Pat. No. 3,620,456 issued Nov. 16, 1971, to Berg, et al.; U.S. Pat. No. 3,630,454 issued Dec. 28, 1971, to Mowbray; and U.S. Pat. No. 3,788,546 issued Jan. 29, 1974, to Bailey, et al.

As pointed out above, because of the conventional arrangement of injection pump cutoff or retraction valves and injector nozzle assemblies, an abrupt termination of the injection of fuel into the cylinder at the end of an injection cycle does not occur. The slow termination of the injection cycle, during which fuel is injected at relatively low pressure increases the amount of unburned hydrocarbons and smoke emitted into the atmosphere by an engine. This also results in a waste of fuel since the after-burned fuel contributes inefficiently, if at all, to the power output of the engine.

SUMMARY AND OBJECTS OF THE INVENTION

Accordingly, it is the primary object of the present invention to overcome the above problems of the prior art.

Another object of the present invention is to provide an injection valve assembly having a shorter injection duration than heretofore known.

A further object of the present invention is to obtain a sharper ending of the injection cycle.

A still further object of the present invention is to provide a combined injection fuel nozzle and retraction valve abruptly terminating the end of an injection cycle.

Still another object of the present invention is to provide an injection assembly that considerably reduces the distance and the amount of fuel between a retraction valve and the fuel nozzle for obtaining a more abrupt ending of the injection cycle.

In accordance with the primary aspect of the present invention, a retraction valve is incorporated within an injector assembly to reduce the distance between the retraction valve and the injection nozzle and thus the quantity of fuel trapped therebetween to improve the rapid termination of the injection cycle.

BRIEF DESCRIPTION OF THE DRAWINGS

The above and other objects and advantages of the present invention will become apparent from the following description when read in conjunction with the drawing wherein.

DETAILED DESCRIPTION OF THE PREFERRED EMBODIMENT

Figure 1:
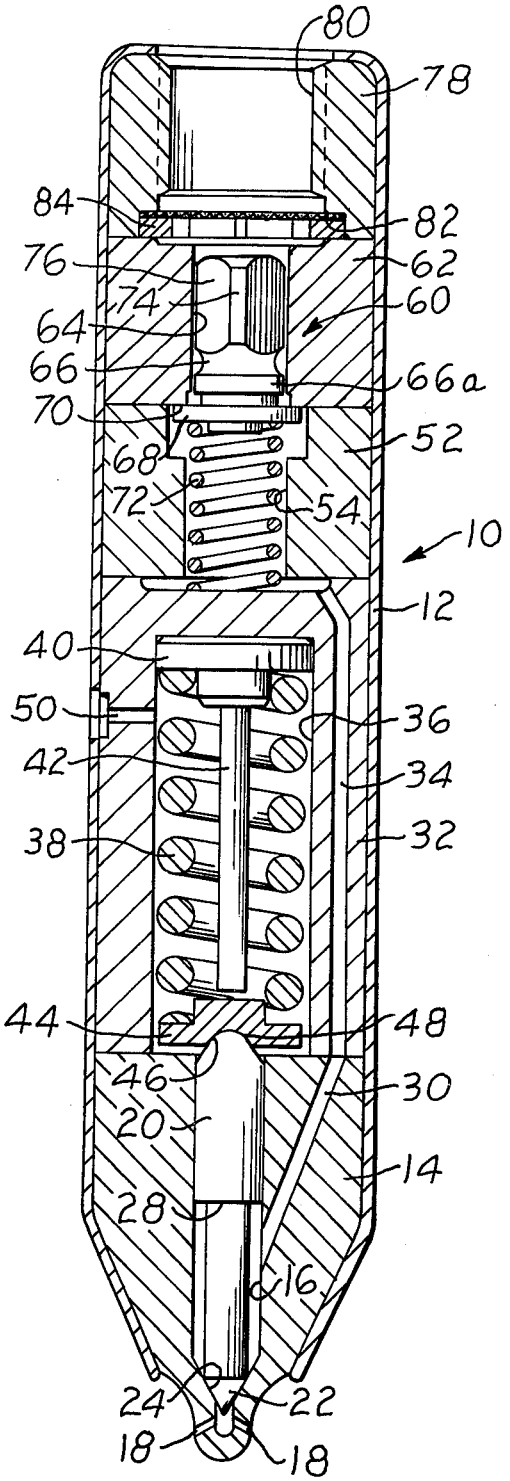
FIG. 1 is an elevational view in section of a preferred embodiment of the present invention.

Turning now to the drawing, there is illustrated a preferred embodiment of the invention comprising an encapsulated injection nozzle assembly indicated generally by the numeral 10 and wherein all components of the assembly are encapsulated in a casing or housing 12 formed at both ends for encompassing and retaining the various components of the assembly therein. The assembly comprises a nozzle tip 14 which includes orifices 18, a valve seat 24, and a central cylindrical bore 16 communicating when the injection valve is unseated with a plurality of orifices or spray outlets 18 for the injection of fuel in a spray pattern into the cylinder or combustion chamber of an engine. An injection valve 20 is disposed within the bore 16 with the upper guide portion of the valve closely fitted to the bore 16 and includes a valve tip 22 seated within the valve seat 24 for controlling the injection of fluid from the orifices 18. The valve 20 is of the inwardly-opening type and responds to pressure acting on a differential area 28 to open for the injection cycle. After the valve 20 is opened the pressure can act on the entire area of the valve guide portion.

A fuel passage 30 communicates fuel to the bore 16 for communication via the spray orifices or nozzles 18 into the combustion chamber. A spring housing 32 includes a passage 34 communicating with the passage 30 of the nozzle tip 14. The spring housing 32 includes a cylindrical central bore 36 in which is disposed a compression spring 38 seated at its upper end in a spring seat 40 which seat also includes an elongated pin member 42 which is adapted to be engaged by a spring seat 44 for limiting the upward travel of valve 20. The spring seat 44 also includes a suitably-shaped surface 46 engaging the upper end 48 of the valve 20. Thus, the valve 20 is biased to its closed position by spring 38. A suitable vent means 50 vents the cylindrical bore 36 to a suitable chamber or reservoir thus preventing a hydraulic lock-up due to fuel leakage between valve 20 and bore 16. A second spring housing 52 includes a central bore 54 providing space for spring 72 and for a portion of valve member 66. A third housing 62 includes a central bore 64 in which is reciprocably mounted a valve 66 shown in a closed position FIG. 1. The valve member 66 includes an annular radially-extending flange 68 defining an annular valve portion which engages a seat 70 in the manner of a poppet valve. The valve member 66 is biased by suitable spring means 72 to its closed or seated position. The valve member 66 includes a main body portion 74 which is shaped preferably from a cylindrical portion providing a close fitting guide in bore 64 and includes a plurality of flats or faces 76 which permit passage of fluid therealong by way of cylindrical bore 64 for communicating with bore 54 and passages 34 and 30 to the spray orifices 18.

Figure 2:
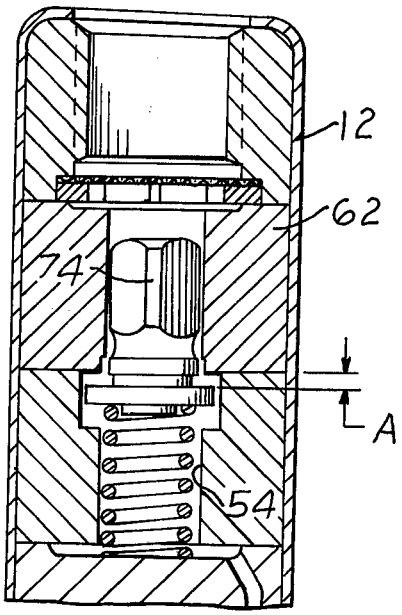
FIG. 2 is a view like FIG. 1 of a portion of the embodiment of FIG. 1 shown in an open position.

FIG. 2 shows valve 66 in open position during the injection cycle where the piston portion 66*a* is shown at the point of entering bore 64. Portion 66*a* of valve member 66 is a cylindrical skirt or piston which is closely fitted to bore 64. During an injection cycle, valve 66 must lift greater than the dimension "A" shown in order that fuel may flow past the piston portion 66*a*. As the end of an injection cycle occurs piston portion 66*a* enters bore 64 because of spring force and this fuel passageway is closed. This starts a "retraction" of fuel from within the nozzle assembly.

This retraction, serving to abruptly decrease the fuel pressure in the nozzle assembly, continues until flange portion 68 seats against seat 70. The retraction volume is equal to the area of piston portion 66*a* times the lift dimension "A" as shown when piston just enters bore 61.

A fourth housing 78 includes a bore 80 defining an inlet to the injection assembly and preferably including thread means or the like for the connection of a fluid line thereto. A filter 82 and filter support plate 84 are disposed between the bore 80 and bore 64 of the next-adjacent portion of the housing.

The above-described construction of the valve body or injection body assembly permits easy construction of the various components thereof and easy assembly thereof simply by encapsulating the components in a shell or the like such as 12. The incorporation of the retraction valve 60 into the injection nozzle assembly 10 closely adjacent to the injection valve 20 provides a construction wherein the passage between the valve 60 and the valve 20 is relatively short and thus a fairly short column of fluid is contained therein during the operation of the injector assembly. This short distance between the retraction valve and the injection valve reduces the amount of fuel trapped at high pressure within the injection nozzle assembly at the end of the injection cycle. In an injection nozzle assembly without the above-described retraction valve, it is the longer time interval required for the trapped fuel to reach a low residual pressure that causes slow rather than abrupt ending of the injection cycle. A slow ending of the injection cycle results in a longer injection duration than is desirable, and also the last portion of the injection cycle having poor characteristics because of low injection pressure. Both of these items tend to increase hydrocarbon emissions and also tend to decrease the smoke limited brake horsepower of a naturally-aspirated engine. Also the desired location of the retraction type valve tends to decrease the possibility of secondary or "after" injections.

As above-described and provided with the subject construction, a very short distance exists between these two valves resulting in a very abrupt ending of the injection cycle.

The reduced distance and the reduced amount of fuel between the retraction valve and the injection valve reduces the pressure variations at the fuel nozzle orifices normally encountered in longer fuel lines. The built-in retraction valve acts to retract a certain amount of fuel from the fuel nozzle to accomplish a sharp and cleaner ending of the injection cycle.

From the above description, it is seen that I have provided a combination fuel nozzle and retraction valve assembly encapsulated within a common housing for reducing the distance between the valves and thus the fuel trapped therein, and also for providing a simple and convenient construction of such an assembly.

While the present invention has been described and illustrated by means of a single embodiment, it is to be understood that numerous changes and modifications may be made therein without departing from the spirit and scope of the invention as defined in the appended claims.

I claim:

1. A fuel injection nozzle assembly comprising:

housing means including inlet means for receiving pressurized fuel from a fuel pump, a fuel chamber, and outlet means for communicating said fuel to the combustion chamber of an engine;

passage means for communicating fuel through said housing from said inlet means to said fuel chamber;

a first valve disposed in said fuel chamber at said outlet means for controlling the flow of fluid from said fuel chamber to said outlet means; and retraction valve means including piston means at said inlet means for retracting a predetermined amount of fuel from the fuel chamber at the end of the injection cycle for establishing a sharp ending of said injection cycle.

2. The fuel injection nozzle assembly of claim 1 wherein said first valve is an inwardly-opening needle valve and said retraction valve means is a pressure-responsive check valve that opens away from said inlet means and is spring biased toward said inlet.

3. The fuel injection nozzle assembly of claim 2 wherein said inlet means includes a bore and an annular valve seat and said piston means includes guide means engaging said bore in said housing means, and a closely fitting piston or skirt engaging said bore and further wherein the retraction valve means includes a radially extending flange means for engaging said annular valve seat.

* * * * *